US010226779B2

(12) United States Patent
Loiti Urquia

(10) Patent No.: US 10,226,779 B2
(45) Date of Patent: Mar. 12, 2019

(54) SPRAY FOR CLEANING PRODUCTS

(71) Applicant: GOIZPER, S.COOP., Antzuola (Gipuzkoa) (ES)

(72) Inventor: Mikel Loiti Urquia, Arrasate (ES)

(73) Assignee: GOIZPER, S.COOP., Antzuola (Gipuzkoa) (ES)

( * ) Notice: Subject to any disclaimer, the term of this patent is extended or adjusted under 35 U.S.C. 154(b) by 19 days.

(21) Appl. No.: 15/501,158

(22) PCT Filed: Aug. 3, 2015

(86) PCT No.: PCT/IB2015/055876

§ 371 (c)(1),
(2) Date: Feb. 1, 2017

(87) PCT Pub. No.: WO2016/020821

PCT Pub. Date: Feb. 11, 2016

(65) Prior Publication Data

US 2017/0216857 A1 Aug. 3, 2017

(30) Foreign Application Priority Data

Aug. 5, 2014 (EP) ..... 14382308

(51) Int. Cl.
*B05B 7/00* (2006.01)
*B05B 15/30* (2018.01)
(Continued)

(52) U.S. Cl.
CPC ..... *B05B 7/0037* (2013.01); *B05B 7/0483* (2013.01); *B05B 7/2467* (2013.01);
(Continued)

(58) Field of Classification Search
CPC ..... B65D 83/682; B65D 83/06; B65D 83/32; B05B 7/0037; B05B 15/30; B05B 7/0483; B05B 7/2467; B05B 15/005
(Continued)

(56) References Cited

U.S. PATENT DOCUMENTS 1,112,202 A * 9/1914 Estes ..... A62C 11/005 169/33
2,653,848 A * 9/1953 Lee ..... A47L 11/325 222/190

(Continued)

FOREIGN PATENT DOCUMENTS

| | | | |
|---|---|---|---|
| EP | 2308603 | A1 | 4/2011 |
| JP | H04-154575 | A | 5/1992 |
| JP | 2005-144221 | A | 6/2005 |

*Primary Examiner* — Patrick M Buechner
*Assistant Examiner* — Michael J Melaragno
(74) *Attorney, Agent, or Firm* — Knobbe, Martens, Olson & Bear, LLP

(57) ABSTRACT

The sprayer comprises a container (1) intended to hold liquid for forming the cleaning mass and pressurized air for spraying it, the container (1) being dismantlably attachable to a head (3) bearing a manual pump (4) to increase the pressure of the air, the head (3) also having a supporting handle (23) with a pushbutton (24) operating the outlet valve (18) for the cleaning mass to the delivery nozzle (22), the sprayer having a manually replaceable mixing device (7, 26) located between the outlet conduit (8) for the liquid from the sprayer container (1) and the outlet of damping mass (20) controlled by the manual valve (18), the mixing device (7, 26) having different passage cross-sections for the liquid and the air present in the container (1) in order to adjust the sprayer to provide cleaning masses with a drier or wetter foam consistency.

8 Claims, 4 Drawing Sheets

(51) Int. Cl.
*B05B 7/04* (2006.01)
*B05B 7/24* (2006.01)
*B05B 7/26* (2006.01)
*B05B 9/08* (2006.01)

(52) U.S. Cl.
CPC ..... *B05B 7/267* (2013.01); *B05B 9/0822* (2013.01); *B05B 15/30* (2018.02)

(58) Field of Classification Search
USPC ..... 222/190
See application file for complete search history.

(56) References Cited

U.S. PATENT DOCUMENTS 2,680,010 A * 6/1954 Dubay ..... B05B 7/0037 239/343
3,422,993 A * 1/1969 Boehm ..... A45D 27/02 222/190
3,428,222 A * 2/1969 Wright ..... A45D 27/02 222/187
3,709,437 A * 1/1973 Wright ..... B05B 7/0037 239/343
3,741,445 A * 6/1973 Green ..... B65D 83/14 222/397
3,785,532 A * 1/1974 Cooprider ..... B05B 11/0016 222/207
3,946,947 A * 3/1976 Schneider ..... A62C 5/002 239/311
3,960,239 A * 6/1976 Frochaux ..... B05B 1/005 138/40
3,985,271 A * 10/1976 Gardner ..... B05B 7/0037 222/190
4,018,364 A * 4/1977 Wright ..... A45D 27/02 222/190
4,019,657 A * 4/1977 Spitzer ..... B65D 83/14 222/136
4,027,789 A * 6/1977 Dickey ..... A61M 11/00 222/190
4,147,306 A * 4/1979 Bennett ..... B05B 11/043 222/212
4,184,615 A * 1/1980 Wright ..... A45D 27/02 222/190
4,219,159 A * 8/1980 Wesner ..... B05B 7/0062 239/343
4,316,673 A * 2/1982 Speer ..... B01F 5/0609 366/337
4,327,782 A * 5/1982 McKibben ..... G01F 11/084 141/26
4,359,096 A * 11/1982 Berger ..... A62C 5/024 169/44
4,396,152 A * 8/1983 Abplanalp ..... B05B 7/0458 239/337
4,531,660 A * 7/1985 Ford, Jr. ..... B05B 11/06 222/207
4,606,477 A 8/1986 Spengler et al.
4,615,467 A * 10/1986 Grogan ..... B05B 11/043 222/190
4,773,570 A * 9/1988 Workum ..... B05B 7/0037 222/190
4,880,161 A * 11/1989 Wright ..... B05B 11/3087 222/190
4,901,925 A * 2/1990 Blake, III ..... B05B 7/0037 222/190
4,925,106 A * 5/1990 Maas ..... B05B 1/12 239/333
4,934,393 A * 6/1990 Lighthall ..... B05B 15/55 134/104.4
4,957,218 A * 9/1990 Ford, Jr. ..... B05B 7/0037 222/1
4,991,779 A * 2/1991 Blake, III ..... B05B 7/0037 222/190
RE33,564 E * 4/1991 Ford, Jr. ..... B05B 7/0037 222/207
5,033,654 A * 7/1991 Bennett ..... B05B 7/0037 222/190
5,054,688 A * 10/1991 Grindley ..... B05B 7/005 169/15
5,071,379 A * 12/1991 Poizot ..... A47K 5/14 210/493.1
5,085,371 A * 2/1992 Paige ..... B05B 7/0062 239/343
5,127,517 A * 7/1992 Clements ..... A45C 11/005 134/137
5,219,102 A * 6/1993 Wright ..... B05B 7/0037 222/190
5,222,633 A * 6/1993 Blake ..... B01F 3/04446 222/179
5,310,093 A * 5/1994 Bennett ..... B05B 7/0018 222/190
5,725,129 A * 3/1998 Chapin ..... B05B 7/0037 222/190
5,725,155 A * 3/1998 Grunenberg ..... B05B 7/0062 239/343
5,842,607 A * 12/1998 Snider ..... A45D 27/10 222/145.6
6,138,875 A * 10/2000 Condon ..... B05B 7/0025 222/401
6,161,712 A * 12/2000 Savitz ..... B01L 3/50825 215/312
6,367,663 B1 * 4/2002 Condon ..... B05B 7/0025 222/190
6,371,332 B1 * 4/2002 Fox ..... A45D 27/12 222/190
6,572,873 B1 * 6/2003 Osman ..... A61K 9/0019 424/423
6,604,693 B2 * 8/2003 Santagiuliana ..... B05B 7/0037 222/190
8,056,768 B2 * 11/2011 Snodgrass ..... A47K 5/14 222/190
9,403,290 B2 * 8/2016 Frailey ..... B01F 5/0608
9,744,545 B2 * 8/2017 Rhea ..... B05B 9/0827
2003/0150624 A1 * 8/2003 Rummel ..... B01F 5/0406 169/43
2005/0002873 A1 * 1/2005 Harman ..... A61K 9/0019 424/47
2006/0062736 A1 * 3/2006 Wright ..... A61K 9/0019 424/45
2006/0280690 A1 * 12/2006 Wright ..... A61B 17/00008 424/45
2007/0003488 A1 * 1/2007 Wright ..... A61B 17/00008 424/47
2008/0237265 A1 * 10/2008 Brouwer ..... B05B 7/0037 222/190
2008/0274060 A1 * 11/2008 Wright ..... A61K 9/0019 424/43
2010/0200615 A1 * 8/2010 Ciavarella ..... B05B 7/0037 222/190
2012/0091228 A1 4/2012 Tseng
2012/0256741 A1 * 10/2012 Ophardt ..... B05B 11/308 340/539.11
2013/0037277 A1 * 2/2013 Henry ..... B01F 5/0428 169/14
2013/0104939 A1 * 5/2013 Shibata ..... B05B 7/0037 134/25.1
2014/0209639 A1 * 7/2014 Sasaki ..... B05B 7/0037 222/190
2014/0361037 A1 * 12/2014 Green ..... B65D 83/48 222/94
2017/0266475 A1 * 9/2017 Mahrt ..... A62C 5/022
2017/0266680 A1 * 9/2017 Ophardt ..... B05B 7/0037

* cited by examiner

SPRAY FOR CLEANING PRODUCTS

This invention provides a sprayer for cleaning products of the type used for applications in the home, for the cleaning of various surfaces such as tiles or the like, upholstery of different types of furniture, etc., by applying a cleaning mass in the form of foam.

Sprayers designed to provide a mass in the form of foam which is sprayed onto the object which has to be cleaned are already known and have various disadvantages, among which may be mentioned the impossibility of adjusting the sprayers to provide so-called dry and wet foams, as the user desires, that is to say, masses of cleaning foam with a drier consistency which may be intended for particular surfaces of domestic objects, upholstery and carpets, and wetter masses, that is to say with a greater proportion of liquid, which are required for surfaces of a different type, such as tiles, glass or vehicles, in which the sprayed mass has to be extended over larger surfaces.

One of the objects of this invention is to provide a sprayer for cleaning products in the form of foam which easily enables the user to adjust the sprayer to obtain wetter or dryer foams, thus making the sprayer more appropriate for the work which has to be done.

The sprayer which is the object of the invention comprises a container for cleaning liquid, which partly fills the container, and also a manual pump to increase the pressure of the air occupying the rest of the internal capacity of the container. A dip pipe for the liquid picks this up close to the bottom of the container, driven by the pressure of the air present in the container, and delivers it to a mixer device, or a mixer device prior to delivery, which is provided by means of a valve that is manually operated through a pushbutton associated with the supporting handle or support for the sprayer, to provide ergonomic handling.

The mixer device is also designed to produce a controlled mixture of the liquid originating from the container and air also from the container, which will give rise to the formation of a mass with a foam consistency which then passes to the delivery device, which comprises a manually operated valve and an outlet tube with a damping mass of felt at its delivery outlet, partly closed off by a nozzle with a gauged passage. The damping mass in which the air and liquid become completely mixed preferably comprises a rectangular piece of felt rolled and inserted into a supporting piece.

This invention provides a mixer device with a replaceable body, which is connected to the top part of the outlet tube for the liquid from the container and which has an axial passage for the liquid and a transverse passage for the air, in such a way that the proportions between the cross-sections of these passages can be varied in accordance with the mass of cleaning foam which it is desired to obtain, whether wetter or drier. The mixing device can be replaced by the user, who will choose between a number provided by the vendor of the sprayer, so that the equipment can be adjusted for different types of cleaning foam.

In a preferred version the mixer device has a dip pipe of constant diameter for the entry of liquid and an air entry which is also of constant diameter, for example, of 9 mm and 0.8 mm respectively, although it is obvious that these figures may differ. Between the lower end where the liquid enters and the opening where the air enters the mixer device has a choke of variable cross-section whose specific value will give rise to different types of cleaning mass provided by the sprayer. For greater convenience, in a preferred version, various openings of predetermined value are provided for this choke, for example diameters of 1.5, 2 and 3 mm, giving rise to three possible mixer devices which the user can change at will in order to obtain different types of cleaning mass with a foam consistency having characteristics between wet and dry. As will be understood, the precise dimensions of the choke openings may vary within broad limits according to the type of the liquid used to form the mass and the particular type of mass which it is desired to obtain.

The sprayer to which this invention relates has an amorphous damper, especially of felt, at the outlet of the delivery conduit, this damper being inserted in a supporting piece and being retained by a front nozzle provided with a gauged outlet opening.

More specifically this invention comprises a sprayer according to claim 1. Preferred embodiments are described in the dependent claims.

For a better understanding representative drawings of a preferred embodiment of this invention are provided by way of an explanatory but not limiting example.

Figure 1:
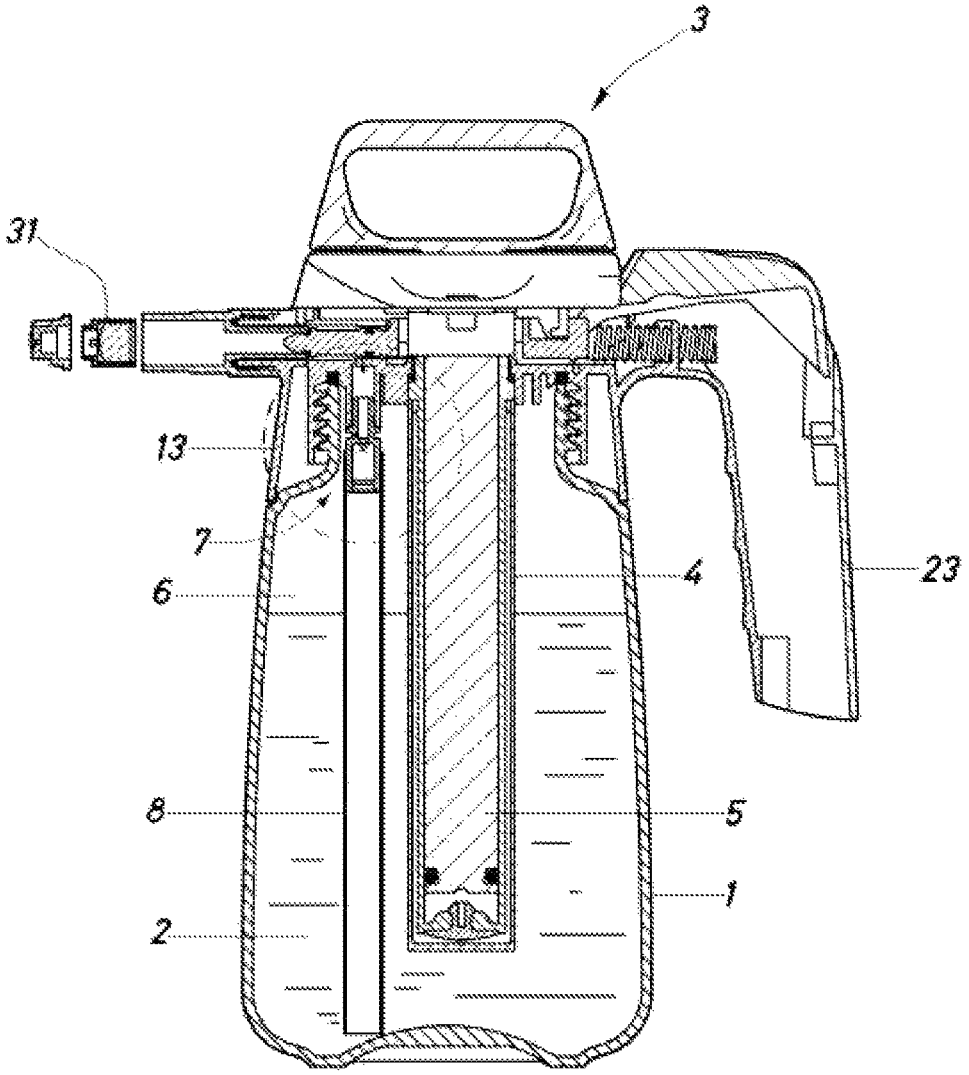
FIG. 1 shows a cross-section of the sprayer along its plane of symmetry.

As will be seen in the drawings, the sprayer to which this invention relates comprises a container -1- intended to contain a liquid -2- to form the cleaning mixture, incorporating a manual pump device with an operating handle -3- and an inner tube -4- in which internal piston -5- moves, together with its seal and one-way valve of a type which is already known and which is designed so that the user can manually increase the pressure of the air mass -6- present in the top of container -1-.

Figure 2:
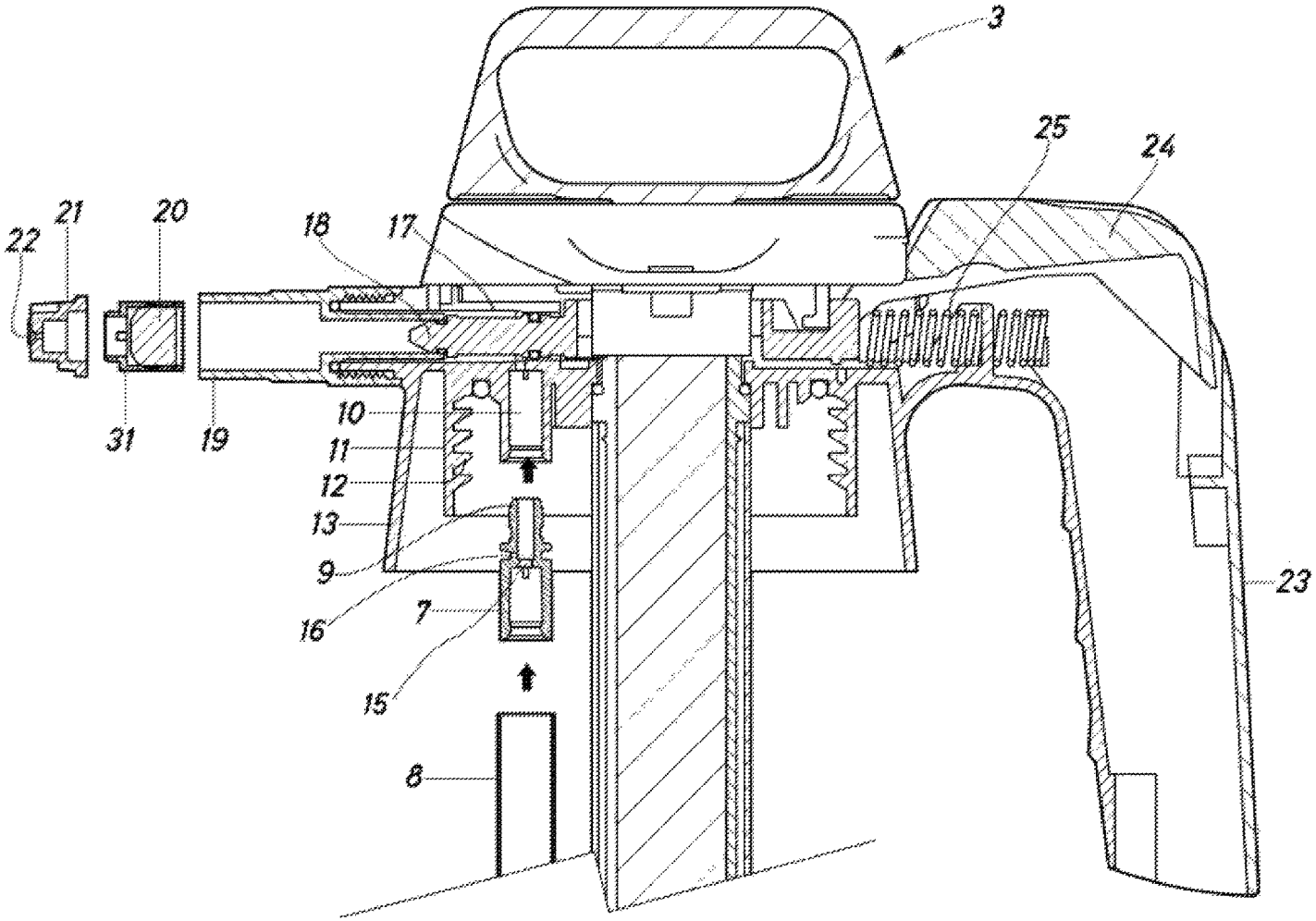
FIG. 2 shows the top or head part of the sprayer on a magnified scale.
Figure 3:
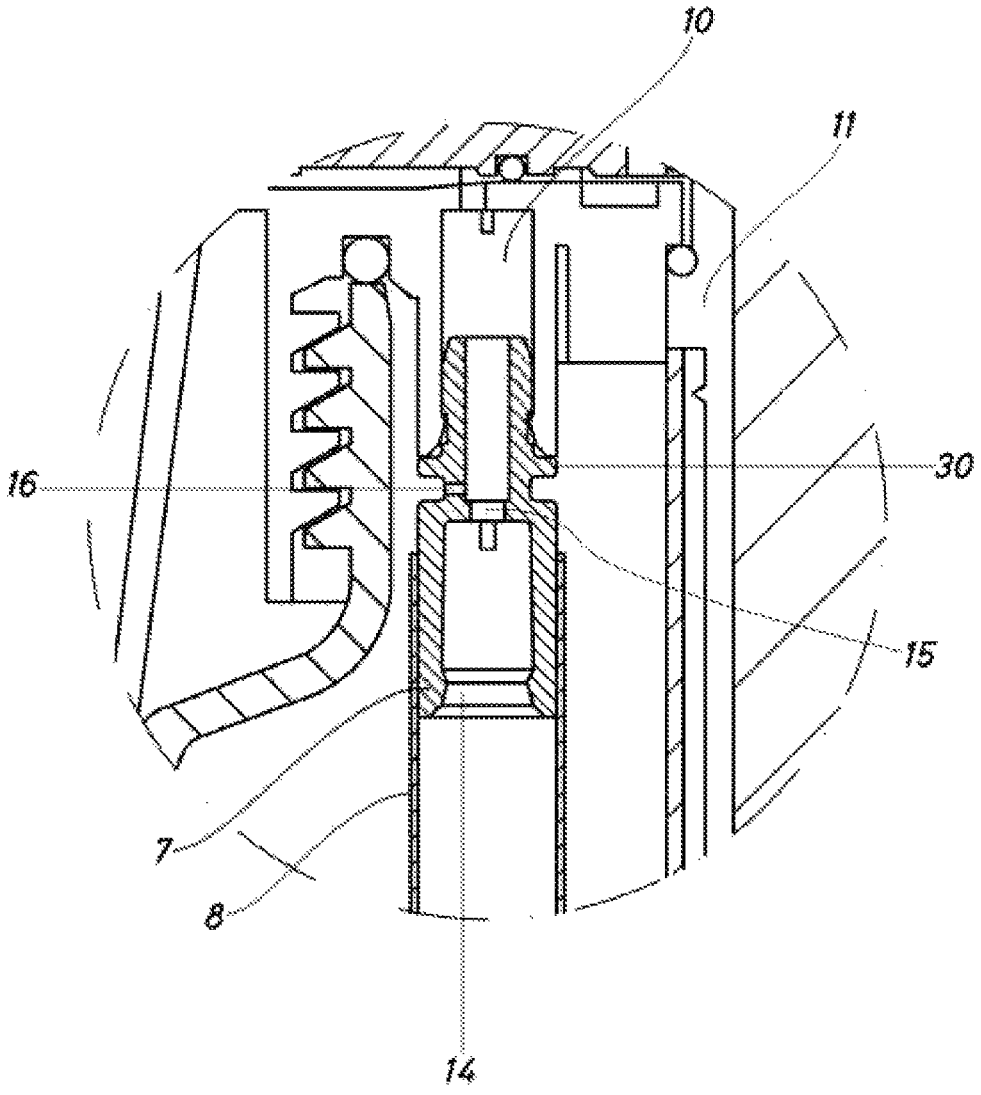
FIG. 3 shows a detail of the mixer device in cross-section.
Figure 4:
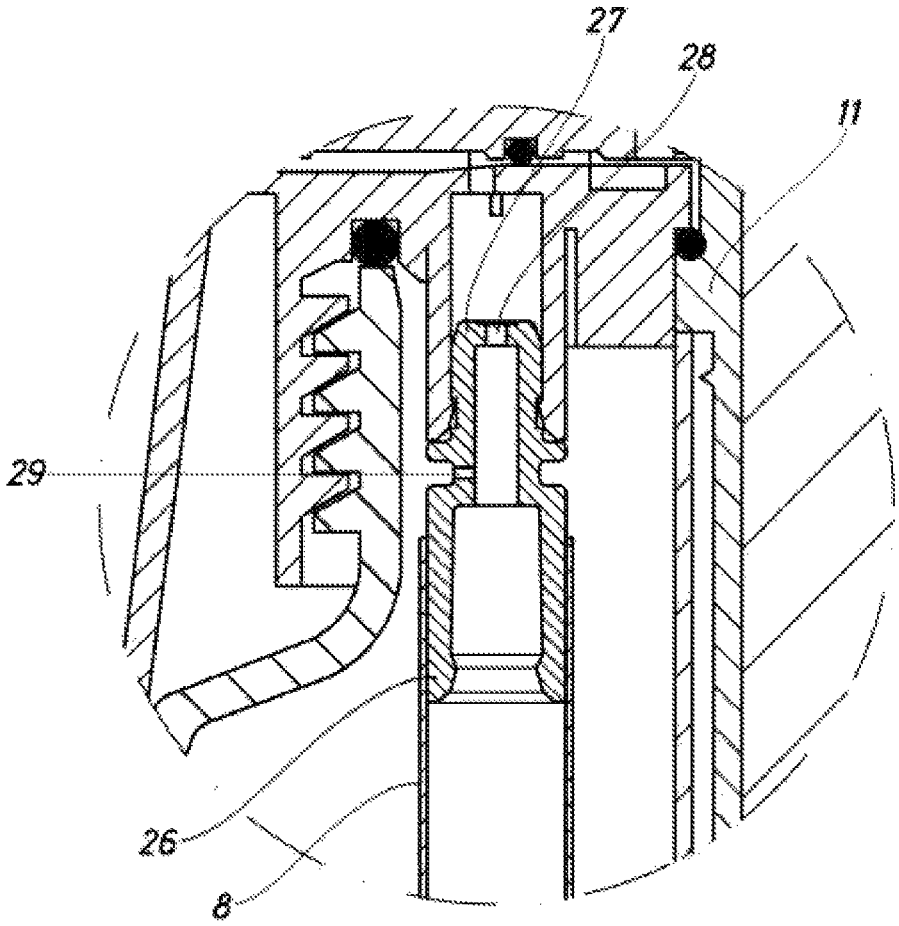
FIG. 4 shows a cross-section of a variant of the mixer device.

Formation of the cleaning mass with a foam consistency takes place through a mixer device -7- incorporated in the top of tube -8- intended for the delivery of liquid -2-, the lower extremity of which is located in the vicinity of the bottom of container -1-. This mixer device, which will be seen in greater detail in FIGS. 2, 3 and 4, is attached by one extremity to the upper extremity of dip pipe -8- for the liquid, and at the other extremity -9- it is connected to a housing -10- in the head -11- of the sprayer, the head being for example connected by means of thread -12- to the upper throat portion of container -1-. This head may have an external skirt -13- which is intended to coincide by its lower end with the outer surface of container -1-, ensuring that the outer surface of the same is of a continuous nature.

Mixer -7- will be seen in greater detail in FIG. 3, and a variant of it is illustrated in FIG. 4. As will be seen in FIG. 3 the structure of the mixer device is in general a hollow cylindrical structure which is attached for example by pressure to the upper extremity of tube -8- and is likewise attached to housing -10- in head -11- of the sprayer through a combination of ribs and recesses or other appropriate system, the mixer also having an intermediate collar -30-, the top of which abuts the bottom edge of housing -10-. The mixer device has a lower opening -14- for the entry of liquid from dip pipe -8- and an intermediate choke -15- for the liquid, which has an adjustable diameter. Above this choke -15- the mixer device has a gauged opening -16- for the entry of air from part -6- of container -1-, which has been pressurised by the manual pump provided with handle -3-. During operation, the liquid originating from dip pipe -8- and the air entering via opening -16- mix to form a cleaning mass which will finally be in the form of a foam having the desired level of moisture content. The cleaning mixture then passes to conduit -17- in the head of the sprayer, controlled by manual valve -18-, and after that valve has been opened it passes to front nozzle -19- the front part of which bears damper mass -20- held in place by nozzle -21- provided with outlet opening -22-. This mass -20-, within which the air and the liquid finally become completely mixed, preferably comprises a rectangular length of felt which has been rolled up and inserted into a supporting piece -31-.

Valve -18- is operated axially from supporting handle -23- of the sprayer through a pushbutton -24- against which an opposing spring -25- acts.

Changing the passage diameters may give rise to the formation of masses having a drier or wetter foam consistency. In the simplest but not exclusive arrangement adopted for the invention a constant diameter is provided for dip pipe -8- and air inlet -16- and variable diameters, for example three separate versions, are provided for the passage of liquid through choke -15-. In a specific embodiment there are provided three mixer devices -7- having a constant diameter of the liquid aspiration opening corresponding to the extremity connected to dip pipe -8-, the latter being for example of 9 mm, the mixer having a passage opening -16- for air which also has a fixed value, for example 0.8 mm, with for example three different versions of mixer device -7-, having passages for liquid of 1.5 mm, 2 mm and 3 mm respectively in choke -15-, for example, although it is obvious that these values may be changed at the manufacturer's convenience, to adjust them to a specific use of the sprayer for different types of foam/different types of surfaces which have to be cleaned.

FIG. 4 shows a variant of the mixer device, in this case indicated by -26-, which has an outlet choke in its upper part, comprising a partly sealing partition -27- and an opening -28- which allows the premixed mass of liquid originating from pipe -8- and air originating from lateral gauged opening -29- to pass outwards.

In the examples illustrated and described mixer device -7- will give rise to a very dry foam if it has an opening of 1.5 mm in inner choke -15- and one of 0.8 mm for the passage of air, with a pipe -8- of 9 mm, given that the proportion of air with respect to liquid will be high. The nature of the cleaning mass will become gradually wetter with the intermediate two millimeter version of the choke opening and more so with the mentioned version having a choke opening of 3 mm, which will give rise to a wetter cleaning mass.

The variant in FIG. 4 which has an upper choke -27-28- will provide a very wet foam.

It is understood from the description that the sprayer can be provided together with several replaceable mixing devices, having each mixing device a different ratio between the size of the opening for the passage of air and the size of the opening for the passage of liquid, thus allowing to adjust the consistency of the foam by replacing one mixing device by another.

It will be understood that the description of an embodiment is purely of an explanatory but not limiting nature and that after studying this description, claims and drawings those skilled in the art will be able to introduce many variants into the invention which will remain with the scope thereof if they are included within the appended claims.

What is claimed is:

1. A sprayer for cleaning products comprising:

a container designed to contain a liquid for the formation of a cleaning mass and pressurised air for spraying, a head bearing a manual pump to increase the pressure of the air, the head also having a supporting handle with a pushbutton for operating a valve for release of the cleaning mass to a delivery nozzle, and a mixing device located between a liquid dip pipe in the container and a damping mass outlet controlled by the valve, wherein the container can be dismantlably attached to the head, the mixing device comprises respective passages for the liquid and the air, the passage for the air is located at a downstream side of an internal choke in a flowing direction of the liquid, and the mixing device is replaceable with a replaceable mixing device in which at least one of the respective passage has a cross-section different from the mixing device to adjust the sprayer to provide cleaning masses with a drier or wetter foam consistency according to the type of application and the user's requirements.

2. A kit comprising:

the sprayer for cleaning products according to claim 1, and a number of replaceable mixing devices with different passage cross-sections.

3. The sprayer for cleaning products according to claim 1 wherein the mixing device is located between a top part of the liquid dip pipe and a housing in the head.

4. The sprayer for cleaning products according to claim 3, wherein the housing is configured to receive a top end of the mixing device having a recess which is configured to be engaged with a rib in the housing.

5. The kit according to claim 2, wherein the number of replaceable mixing devices have the internal choke between a lower end where the liquid enters and an opening where the air enters into the mixing device, and each replaceable mixing device has a different diameter for the passage of liquid.

6. The kit according to claim 5, wherein the internal choke is located between the entry of liquid in the replaceable mixing device and the air entry.

7. The sprayer for cleaning products according to claim 1 further comprising:

an amorphous damper mass at an outlet extremity of a delivery conduit of the head retained by a nozzle connected to the delivery conduit, and having a gauged outlet opening for the cleaning mass.

8. The sprayer for cleaning products according to claim 7, wherein the amorphous damper mass in which the air and liquid complete their mixing comprises a rectangular piece of felt, said rectangular piece of felt is rolled and is inserted into a supporting piece.

* * * * *